US009500999B2

(12) United States Patent
Koshida

(10) Patent No.: US 9,500,999 B2
(45) Date of Patent: Nov. 22, 2016

(54) IMAGE FORMING APPARATUS HAVING POSITIONING OF TRANSFER UNIT INTERLOCKED WITH CLOSING OF MAIN BODY DOOR

(71) Applicant: CANON KABUSHIKI KAISHA, Tokyo (JP)

(72) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 14/721,170

(22) Filed: May 26, 2015

(65) Prior Publication Data

US 2015/0346646 A1 Dec. 3, 2015

(30) Foreign Application Priority Data

May 30, 2014 (JP) ..... 2014-112409

(51) Int. Cl.
*G03G 15/16* (2006.01)
*G03G 21/16* (2006.01)

(52) U.S. Cl.
CPC ..... *G03G 15/1605* (2013.01); *G03G 21/1633* (2013.01); *G03G 21/168* (2013.01); *G03G 21/1647* (2013.01); *G03G 2215/0132* (2013.01)

(58) Field of Classification Search
CPC ..... G03G 15/161; G03G 15/0131; G03G 2215/1661; G03G 15/1605; G03G 15/1685; G03G 21/1633; G03G 21/1674; G03G 21/168; G03G 2215/0132
USPC ..... 399/124, 297, 302, 388, 400; 271/265.02
See application file for complete search history.

(56) References Cited

U.S. PATENT DOCUMENTS

| | | | | |
|---|---|---|---|---|
| 7,917,062 | B2 | 3/2011 | Shin et al. | |
| 2009/0129815 | A1* | 5/2009 | Kouzu | G03G 21/168 399/121 |
| 2010/0278557 | A1* | 11/2010 | Somemiya | G03G 21/1647 399/124 |
| 2011/0293326 | A1* | 12/2011 | Tanabe | G03G 21/1633 399/124 |
| 2014/0079434 | A1* | 3/2014 | Sakashita | G03G 21/1633 399/121 |
| 2014/0099142 | A1* | 4/2014 | Ando | G03G 21/1633 399/110 |
| 2014/0140727 | A1* | 5/2014 | Shimoi | G03G 21/1633 399/121 |

FOREIGN PATENT DOCUMENTS

| | | | |
|---|---|---|---|
| JP | 2006-282381 | A | 10/2006 |
| JP | 2009-139448 | A | 6/2009 |
| JP | 2009-251135 | A | 10/2009 |
| JP | 5084588 | B2 | 11/2012 |
| JP | 5134347 | B2 | 1/2013 |
| JP | 2013-216448 | A | 10/2013 |

* cited by examiner

*Primary Examiner* — Francis Gray
(74) *Attorney, Agent, or Firm* — Fitzpatrick, Cella, Harper & Scinto

(57) ABSTRACT

An image forming apparatus includes a door movably holding a transfer unit; a first roller movably held by the door and a second roller provided on the main body for conveying a recording material; a transfer positioning member provided on the main body to be interlocked with rotation of the door, the transfer positioning member positioning the transfer unit with respect to the main body with the transfer member being in contact with the image bearing member; and a roller positioning member provided on the main body to be interlocked with rotation of the door, the roller positioning member positioning the first roller with respect to the main body with the first roller being in contact with the second roller.

20 Claims, 16 Drawing Sheets

IMAGE FORMING APPARATUS HAVING POSITIONING OF TRANSFER UNIT INTERLOCKED WITH CLOSING OF MAIN BODY DOOR

BACKGROUND OF THE INVENTION

Field of the Invention

The present invention relates to an image forming apparatus for forming an image on a sheet.

Description of the Related Art

As a conventional electrophotographic image forming apparatus, the image forming apparatus is widely known that transfers the toner images of respective colors on the intermediate transfer belt in a sequentially superimposed manner and then transfers the toner images borne on the intermediate transfer belt to a recording material in a lump by the transfer roller. Such an image forming apparatus is usually configured such that the transfer roller is able to be separated from the intermediate transfer belt during the jam recovery for facilitating the jam recovery by a user. Specifically, a door rotatable with respect to the main body of the image forming apparatus is provided and the transfer roller is separated from the intermediate transfer belt while being interlocked with an operation of opening and closing of the door.

In view of recording accuracy of an image, it is necessary to set a high contact pressure of the transfer roller to the intermediate transfer belt. In this case, when the pressure is set to 3 kgf to 8 kgf (29.1N to 78.4N) for example, the opening and closing operation of the door becomes heavier in order to generate this contact pressure.

In order to lighten the opening and closing operation of the door, there is a structure in which a transfer unit attached rotatably to the main body of an image forming apparatus and a lock mechanism act in an interlocking manner with the rotation of the door (Japanese Patent Laid-Open No. 2009-251135). In Japanese Patent Laid-Open No. 2009-251135, the position of the secondary transfer roller relative to the body is determined so as to reduce a user operation force when the secondary transfer roller is in contact with the intermediate transfer belt.

In such a conventional image forming apparatus, the user operating force is reduced when opening and closing the door. However, the entire conveying path of the recording material cannot be opened since the transfer unit is provided at the main body of the image forming apparatus so as to be able to rotate. Therefore, when a user has opened the door for recovering jam, the transfer unit may block the conveying path which is disposed in the upstream of the transfer unit from the user's view depending on the location of conveying path for the recording material before entry into the transfer portion, which may deteriorate user's visibility.

Further, a nip of the registration roller for conveying a recording material may not be released, thereby visibility for the conveying path may deteriorate. Furthermore, even though the door can be opened when jam occurs, the recording material remains nipped at the registration roller to which the force of 2 kgf to 4 kgf (19.6N to 39.2N) is applied. Therefore, a user must pull up a recording material more strongly than the nip force of the registration roller when the user handles the recording material, thereby it becomes more difficult to recover jam. On the other hand, when the structure is employed in which the nip of the registration roller is in contact or is separated in accordance with opening and closing of the door, there is a problem that the opening and closing operation becomes heavy due to the contact pressure of 2 kgf to 4 kgf (19.6N to 39.2N).

SUMMARY OF THE INVENTION

The present invention provides an image forming apparatus of which operational force for opening and closing a door can be reduced and in which it is easy to remove a recording material when the door is opened.

A typical configuration of the present invention is: an image forming apparatus, comprising:

an image bearing member which is provided in the main body of the image forming apparatus, the image bearing member bearing a toner image;

a transfer unit which includes a transfer member for transferring the toner image borne on the image bearing member to a recording material;

a door which is movably provided on the main body, the door movably holding the transfer unit in a movable manner;

a roller pair including a first roller which is movably held by the door and a second roller provided on the main body, the roller pair conveying the recording material to which the toner image borne on the image bearing member is transferred by the transfer member;

a transfer positioning member which is provided on the main body such that the transfer positioning member is interlocked with the rotation of the door, the transfer positioning member positioning the transfer unit with respect to the main body with the transfer member being in contact with the image bearing member; and a roller positioning member which is provided on the main body such that the roller positioning member is interlocked with the rotation of the door, the roller positioning member positioning the first roller with respect to the main body with the first roller being in contact with the second roller.

Further features of the present invention will become apparent from the following description of exemplary embodiments with reference to the attached drawings.

DESCRIPTION OF THE EMBODIMENTS

Figure 1:
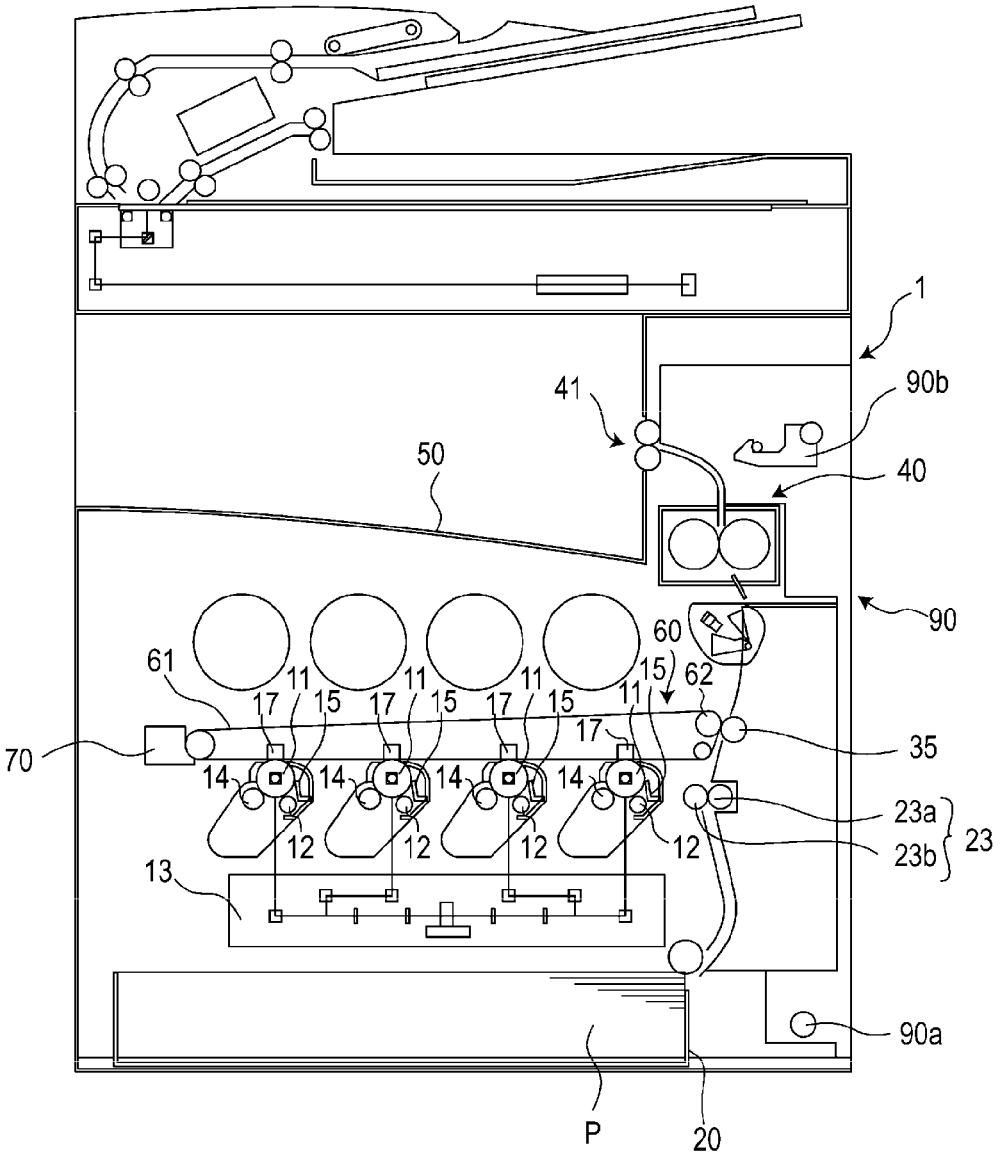
FIG. 1 is a cross-sectional view showing an entire image forming apparatus of the first embodiment of the present invention.

First Embodiment (Image forming apparatus) The entire configuration of an image forming apparatus of the first embodiment of the present invention will be explained. FIG. 1 is a sectional view showing the entire image forming apparatus of the first embodiment. The image forming apparatus 1 includes image forming units of yellow Y, magenta M, cyan C and black Bk, respectively. Each configuration of the image forming units is the same as the other units except for the color of the toner housed therein. Therefore, in the following description, the subscripts Y, M, C and Bk will be omitted.

The surface of the photosensitive drum 11 is uniformly charged by the charging roller 12. After that, an electrostatic latent image is formed on the photosensitive drum 11 by the laser scanner 13 which is driven based on a signal indicative of the transmitted image data. The electrostatic latent image is visualized as a toner image by the developing device 14. The toner image on the photosensitive drum 11 is sequentially transferred (primarily transferred) to the intermediate transfer belt 61 (image bearing member) by being granted a predetermined pressure and an electrostatic load bias by the primary transfer roller 17. After the transfer, the residual toner slightly remaining on the photosensitive drum 11 is removed and collected by the drum cleaner 15 in order to become ready again for the next image formation.

On the other hand, the recording material P is fed one by one from the sheet cassette 20 and is conveyed to the registration roller pair 23. A loop is formed at the tip of the recording material P while the tip is in contact with the nip portion of the registration roller pair 23, thereby the skew is corrected. Thereafter, in synchronization with the toner image borne on the intermediate transfer belt 61, the resist roller pair 23 conveys the recording material P between the transfer drive roller 62 which drives the intermediate transfer belt 61 which is transferring means and the secondary transfer outer roller 35 (secondary transfer member). In addition, the secondary transfer outer roller 35 is assembled integrally with the secondary transfer unit 30 (see FIG. 2) which will be described later. The secondary transfer outer roller 35 is separated from the transfer drive roller 62 at the time of the opening and closing of the door 90.

At the nip portion between the transfer drive roller 62 and the secondary transfer outer roller 35 which is disposed so as to be opposed to the transfer driving roller 62, a predetermined pressure and electrostatic load bias are applied to the toner image. Thus, the color toner image on the intermediate transfer belt 61 is secondarily transferred to the recording material P. After the transfer, the residual toner slightly remaining on the intermediate transfer belt 61 is removed and collected by the belt cleaner 70 in order to become ready again for the next image formation. The toner image transferred onto the recording material P is fixed by being heated and pressurized by the fixing device 40 (fixing unit) and then, the recording material P is discharged onto the discharge tray 50 by the discharge roller pair 41.

The intermediate transfer belt 61 and a plurality of the stretching rollers including the transfer drive roller 62 which stretches the intermediate transfer belt 61 are integrated as the intermediate transfer unit 60. The configuration of the intermediate transfer unit 60 will be described later.

Also, the door 90 is formed at the right side of the image forming apparatus 1 in FIG. 1. The door 90 can be opened and closed with respect to the main body of the apparatus. The door 90 of the present embodiment has the rotational center 90*a* at a lower portion thereof and is rotatable about the rotational center 90*a*. Further, the engaging portion 90*b* is formed at an upper portion of the door 90. The engaging portion 90*b* engages with an engaging portion formed in the main body of the image forming apparatus 1, thereby the door 90 remains closed with respect to the main body of the image forming apparatus 1.

Figure 2:
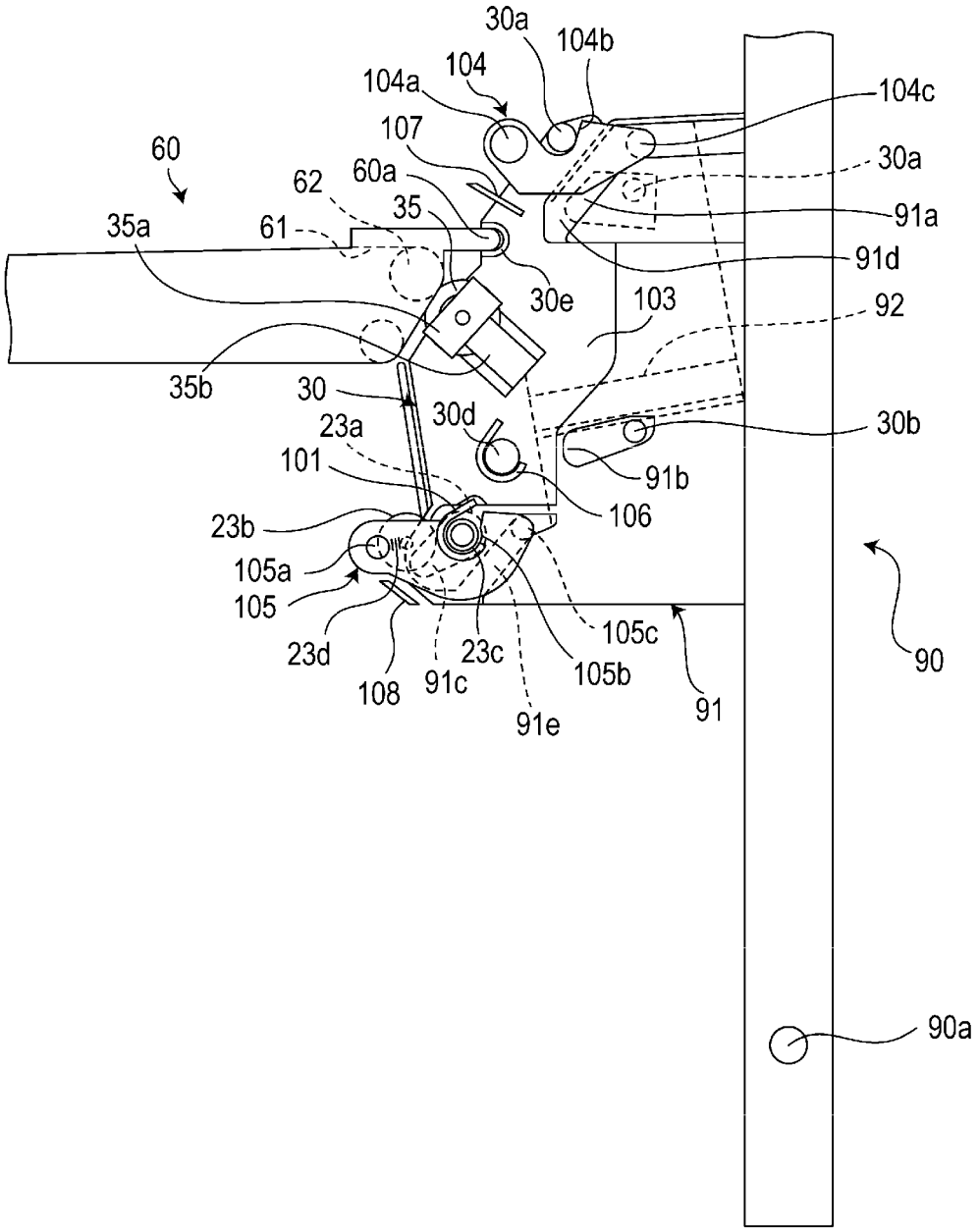
FIG. 2 is a side view of the periphery of a door of the first embodiment of the present invention.
Figure 3:
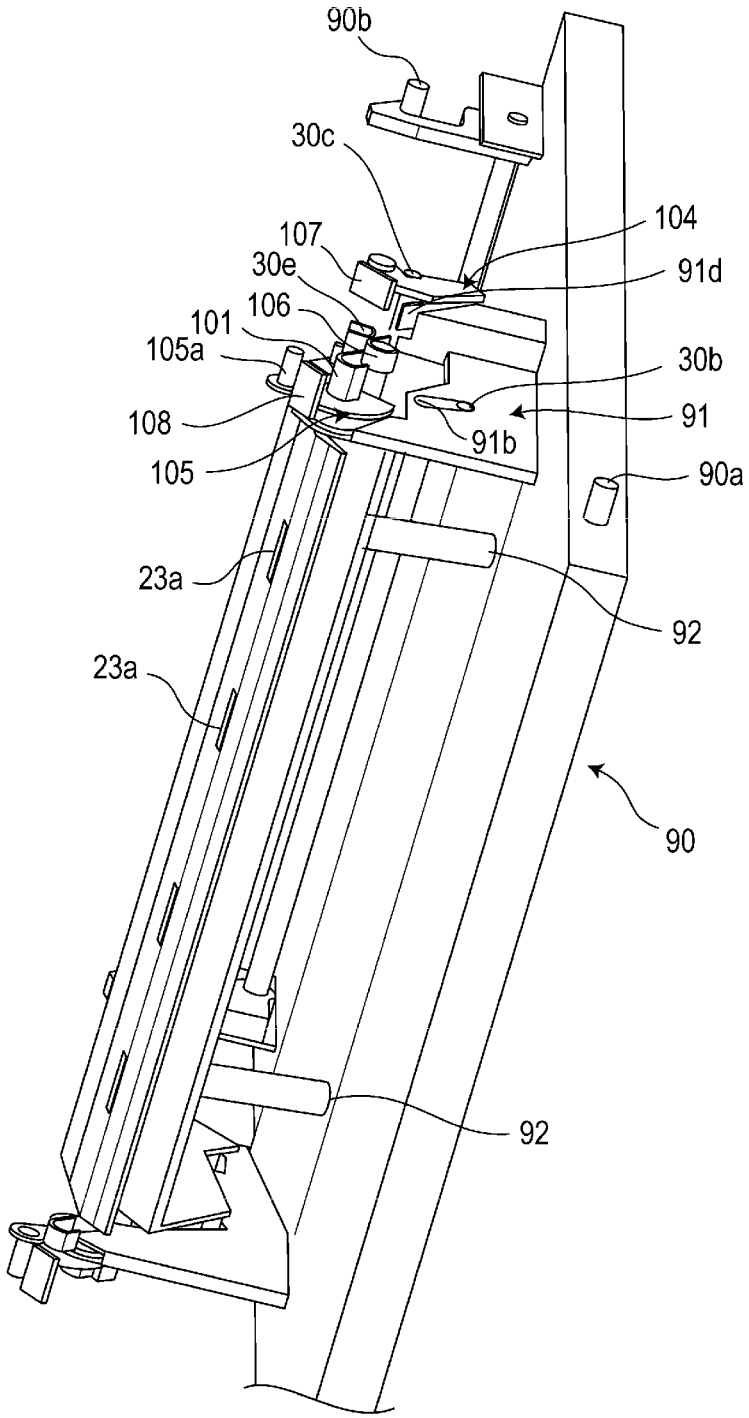
FIG. 3 is a perspective view from the bottom of the periphery of a door of the first embodiment of the present invention.
Figure 4:
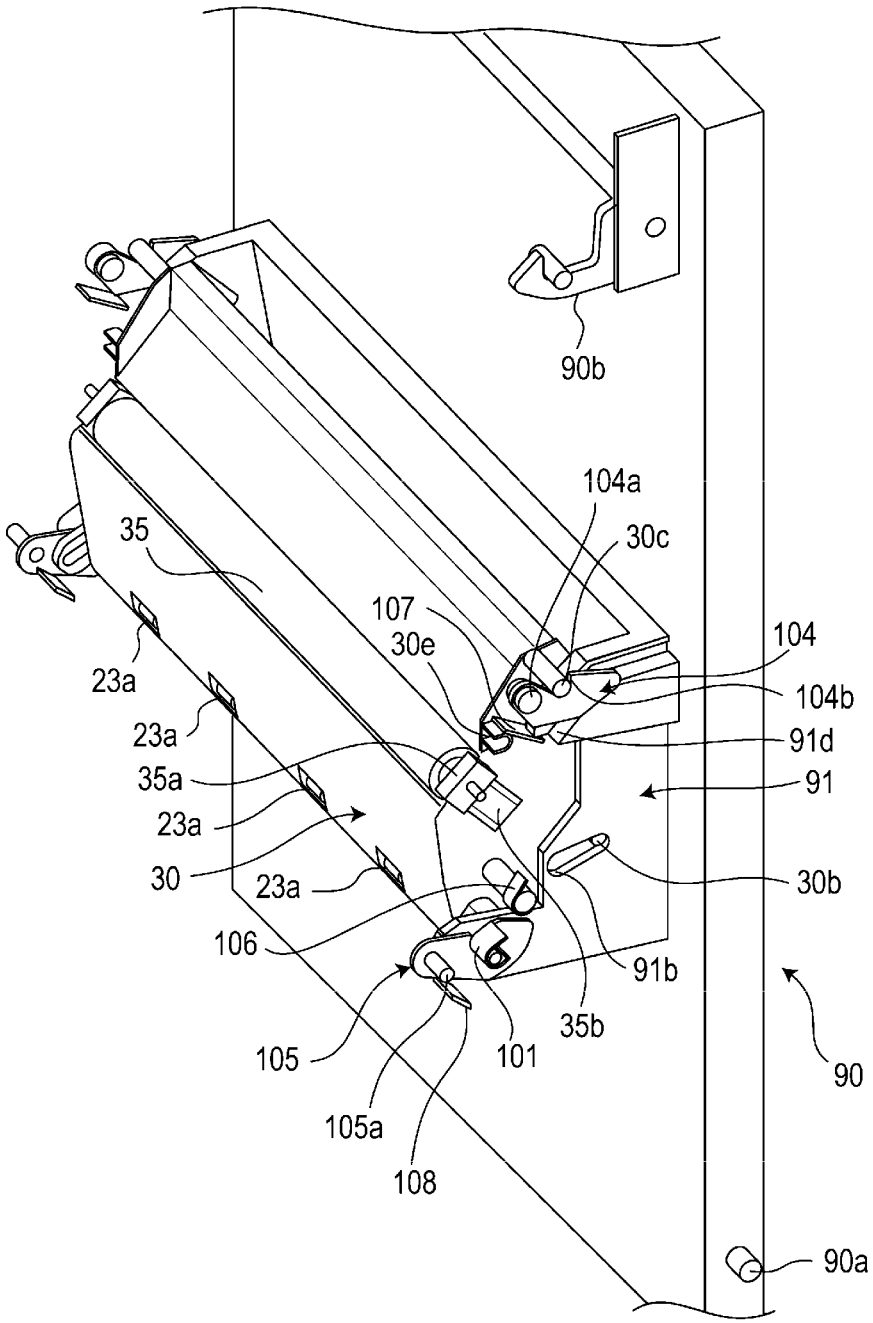
FIG. 4 is a perspective view from the top of the periphery of the door of the first embodiment of the present invention.
Figure 5:
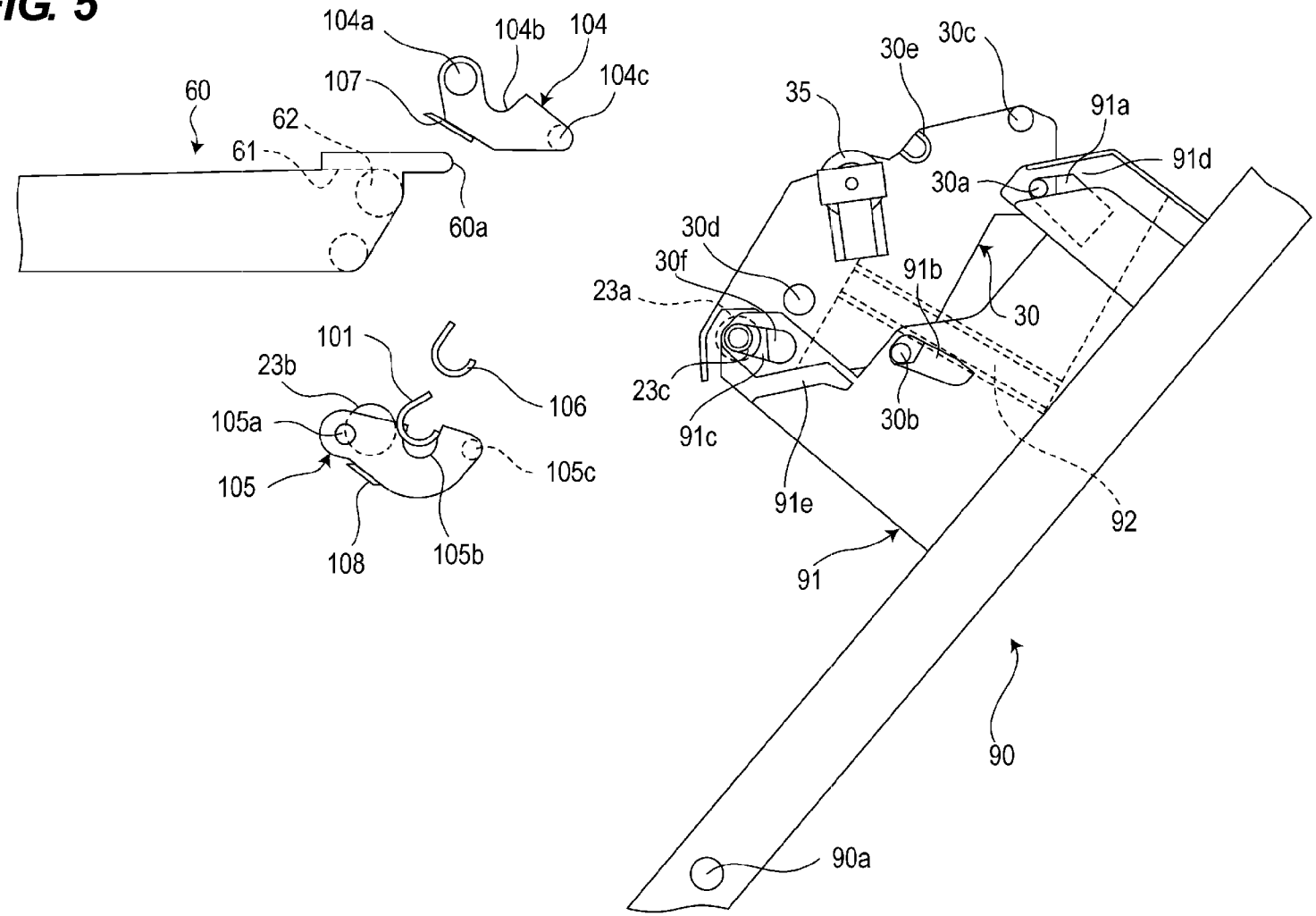
FIG. 5 is a side view illustrating an open state of the door of the first embodiment of the present invention.

(Configuration of the door) The relationship of the door and the peripheral of the door will be explained with reference to FIGS. 2 to 4. FIG. 2 is a side view of the peripheral of the door of the first embodiment. FIG. 3 is a perspective view from the bottom of the periphery of the door of the first embodiment. FIG. 4 is a perspective view from the top of the periphery of the door of the first embodiment. FIG. 5 is a side view showing the open state of the door of the first embodiment.

As shown in FIG. 2, the door 90 can be rotated around the rotational center 90*a*. The door 90 is a part of the exterior member of the main body of the image forming apparatus 1.

As shown in FIGS. 2 to 4, the unit holder 91 is integrally disposed at the inside of the door 90. The unit holder 91 holds the secondary transfer unit 30 having the secondary transfer outer roller 35 at both longitudinal ends. An engaging portion is formed on the unit holder 91 for holding the secondary transfer unit 30. Specifically, the upper restricting portion 30*a* cylindrically formed on the secondary transfer unit 30 engages with the upper restricting guide hole 91*a* formed at an upper portion of the unit holder 91. On the other hand, the lower restricting portion 30*b* cylindrically formed on the secondary transfer unit 30 engages with the lower restricting guide hole 91*b* formed on a lower portion of the unit holder 91.

Further, as shown in FIG. 3, the door 90 has the floating spring 92 (elastic member) which biases the secondary transfer unit 30 in the direction to the intermediate transfer unit 60. With such a configuration, the secondary transfer unit 30 is held so as to be integrally movable with respect to the unit holder 91 formed on the door 90 while receiving urging force in the direction to the intermediate transfer unit 60 side by the floating spring 92.

The registration roller pair 23 described above includes the registration drive roller (first roller) 23*a* which is directly driven and the registration driven roller (second roller) 23*b* which is opposed to the registration drive roller 23*a*. The longitudinal end of the registration drive roller 23*a* of the registration roller pair 23 is held by the unit holder 91. Specifically, as shown in FIG. 5, the roller restricting guide hole 91*c* is formed in the vicinity of the lower end of the unit holder 91. The roller restricting guide hole 91*c* holds the registration drive roller bearing 23*c* disposed at the longitudinal end of the registration drive roller 23*a*.

(Configuration around the transfer unit) Next, with reference to FIGS. 2 to 5, the configuration around the secondary transfer unit 30 will be described. As shown in FIG. 5, the positioning portion 30*c* which is of a cylindrical shape is disposed at the inner side of the apparatus (side of intermediate transfer unit 60) on an upper portion of the secondary transfer unit 30. Then, in order to position and fix the positioning portion 30*c* with respect to the image forming apparatus 1, the transfer lock arm 104 (transfer positioning member) is provided in the main body of the image forming apparatus 1.

The transfer lock arm 104 is rotatable about the rotational center 104*a*. The lock portion 104*b* is formed on the transfer lock arm 104 for fixing the secondary transfer unit 30 as shown in FIG. 4 by engaging the positioning portion 30*c*. On the transfer lock arm 104, the lock angle restricting portion 104*c* of a protrusion shape is formed. By being positioned with respect to the unit holder 91, the lock angle restricting portion 104*c* restricts the lock angle.

Upon opening and closing of the door 90, the lock angle restricting portion 104*c* is guided inside the lock portion guide 91*d* formed on an upper end of the unit holder 91. Since the lock angle restricting portion 104*c* is guided by the lock portion guide 91*d*, the lock angle restricting portion 104*c* is interlocked with the movement of the unit holder 91. For this reason, the transfer lock arm 104 is interlocked with opening and closing of the door 90.

Since the lock angle restricting portion 104*c* of the transfer lock arm 104 is guided by the lock portion guide 91*d*, the transfer lock arm 104 exerts a constant positioning accuracy. As shown in FIG. 5, the restricting member 107 is disposed in the image forming apparatus 1. When the door is in the open state, the restricting member 107 restricts the movement of the transfer lock arm 104 so that the transfer lock arm 104 does not go below a certain position.

Further, in the secondary transfer unit 30, the fitting projection 30*d* for engaging with the image forming apparatus 1 is disposed below the secondary transfer outer roller 35 and closer to the intermediate transfer unit 60 than the lower restricting portion 30*b*. For engaging with the fitting projection 30*d*, the U-shaped hole 106 is formed in the image forming apparatus 1 as shown in FIG. 5. The fitting projection 30*d* (rotational center portion) of the secondary transfer unit 30 is fitted into the fitting hole 106. The secondary transfer unit 30 is configured such that the secondary transfer unit 30 is rotatable about the fitting projections 30*d* with respect to the main body when opening and closing the door 90.

With this configuration, the secondary transfer unit 30 is positioned with respect to the image forming apparatus 1. That is, at the upper portion of the secondary transfer unit 30, the positioning portion 30*c* is positioned by the transfer lock arm 104. At the lower portion, the fitting projection 30*d* is positioned by the fitting hole 106.

The secondary transfer unit 30 is also positioned with respect to the intermediate transfer unit 60 in the closed state. As shown in FIG. 5, the fitting groove 30*e* is formed such that an opening is provided in the direction to the intermediate transfer unit 60 side of the secondary transfer unit 30. Therefore, as shown in FIG. 2, when closing the door 90, the positioning protrusion 60*a* formed on the intermediate transfer unit 60 is fitted into the fitting groove 30*e* of the secondary transfer unit 30. Thereby the secondary transfer unit 30 is positioned with respect to the intermediate transfer unit 60.

As described above, the secondary transfer unit 30 is assembled so as to be integrated with the unit holder 91 and to be movable with respect to the unit holder 91 in a certain range. That is, the upper restricting portion 30*a* of the secondary transfer unit 30 is movable inside the upper restricting guide hole 91*a* of the unit holder 91. The lower restricting portion 30*b* of the secondary transfer unit 30 is movable inside the lower restricting guide hole 91*b* of the unit holder 91. As a result, the secondary transfer unit 30 moves integrally with the door 90 in accordance with opening and closing operation of the door 90.

As shown in FIGS. 2 and 4, the both ends of the secondary transfer outer roller 35 are supported by the support holder 35*a*. The support holder 35*a* is movably held by the secondary transfer unit 30. The transfer spring 35*b* for biasing the secondary transfer outer roller 35 toward the intermediate transfer belt 61 is provided between the support holder 35*a* and the secondary transfer unit 30. The transfer nip pressure between the intermediate transfer belt 61 and the secondary transfer outer roller 35 is generated by the transfer spring 35*b*. When the door 90 is closed, the transfer lock arm 104 receives the force of the transfer spring 35*b* which generates the transfer nip pressure.

(Configuration around the registration drive roller) Next, the configuration around the registration drive roller 23*a* will be described. As shown in FIGS. 2 to 5, the registration lock arm 105 is disposed at the main body of the image forming apparatus 1 as a roller positioning member The registration lock arm 105 is rotatable about the rotational center 105*a*. The lock portion 105*b* is provided on the registration lock arm 105. The lock portion 105*b* fixes the registration roller pair 23 as shown in FIG. 4 by engaging the registration drive roller bearing 23*c* of the registration drive roller 23*a*. The lock angle restricting portion 105*c* of a protrusion shape is formed on the registration lock arm 105. The lock angle restricting portion 105*c* restricts the lock angle by being positioned with respect to the unit holder 91. When the door 90 is opened and closed, the lock angle restricting portion 105*c* is guided inside the registration guide 91*e* formed at the lower end of the unit holder 91.

In this way, because the lock angle restricting portion 105*c* is guided by the registration guide 91*e*, the registration lock arm 105 is interlocked with the movement of the unit holder 91. For this reason, the registration lock arm 105 is interlocked with opening and closing operation of the door 90. Also, by the lock angle restricting portion 105*c* of the registration lock arm 105 being guided by the registration guide 91*e*, the registration lock arm 105 exerts the positioning accuracy of a certain level.

As shown in FIG. 5, the restricting member 108 is disposed in the image forming apparatus 1. The restricting member 108 restricts the movement of the registration lock arm 105 so that the registration lock arm 105 does not go below a certain position when the door is opened. The fitting hole 101 (positioning portion) is disposed in the image forming apparatus 1 for positioning the registration drive roller bearing 23*c* of the registration drive roller 23*a* with respect to the image forming apparatus 1.

The registration drive roller 23*a* is assembled so as to be integrated with the unit holder 91 and to be movable with respect to the unit holder 91 in a certain range. That is, the registration drive roller bearing 23*c* of the registration drive roller 23*a* is movable inside the roller restricting guide hole 91*c* formed at a lower portion of the unit holder 91. Therefore, the registration drive roller 23*a* moves integrally with the door 90 in accordance with opening and closing of the door 90.

The registration roller pair 23 includes the registration drive roller 23*a* and the registration driven roller 23*b*.

Between the registration driven roller 23*b* and the main body, provided is the biasing spring 23*d* (roller biasing spring) for biasing the registration driven roller 23*b* in the direction to the registration drive roller 23*a*. The nip pressure between the registration driven roller 23*b* and the registration drive roller 23*a* is generated by the biasing spring 23*d*. When the door 90 is closed, the registration lock arm 105 receives the force of the biasing spring 23*d* which generates the roller nip pressure of the registration roller pair 23.

(Closing operation of the door) Next, the closing operation of the door by a user will be explained. First, as a step prior to performing the closing operation, in the state in which the door 90 is opened as shown in FIG. 5, the secondary transfer unit 30 is integrally assembled to the unit holder 91 of the door 90 while being biased to the direction to the inside of the apparatus. The registration drive roller 23*a* is also assembled to the unit holder 91 at a lower portion of the secondary transfer unit 30.

In this state, the secondary transfer unit 30 and the registration drive roller 23*a* are separated from the intermediate transfer unit 60. They are also separated from the transfer lock arm 104 provided in the image forming apparatus 1, the registration lock arm 105 and the fitting hole 106.

Then, the closing operation of the door 90 will be explained using side views illustrating the closing operation of the door of the first embodiment of FIGS. 6 to 10. The door 90 is gradually closed in the order from FIG. 6 to FIG. 10. In the following description, the engaging motion around the secondary transfer unit 30 and the engaging motion about registration drive roller 23*a* will be described in detail.

Figure 6:
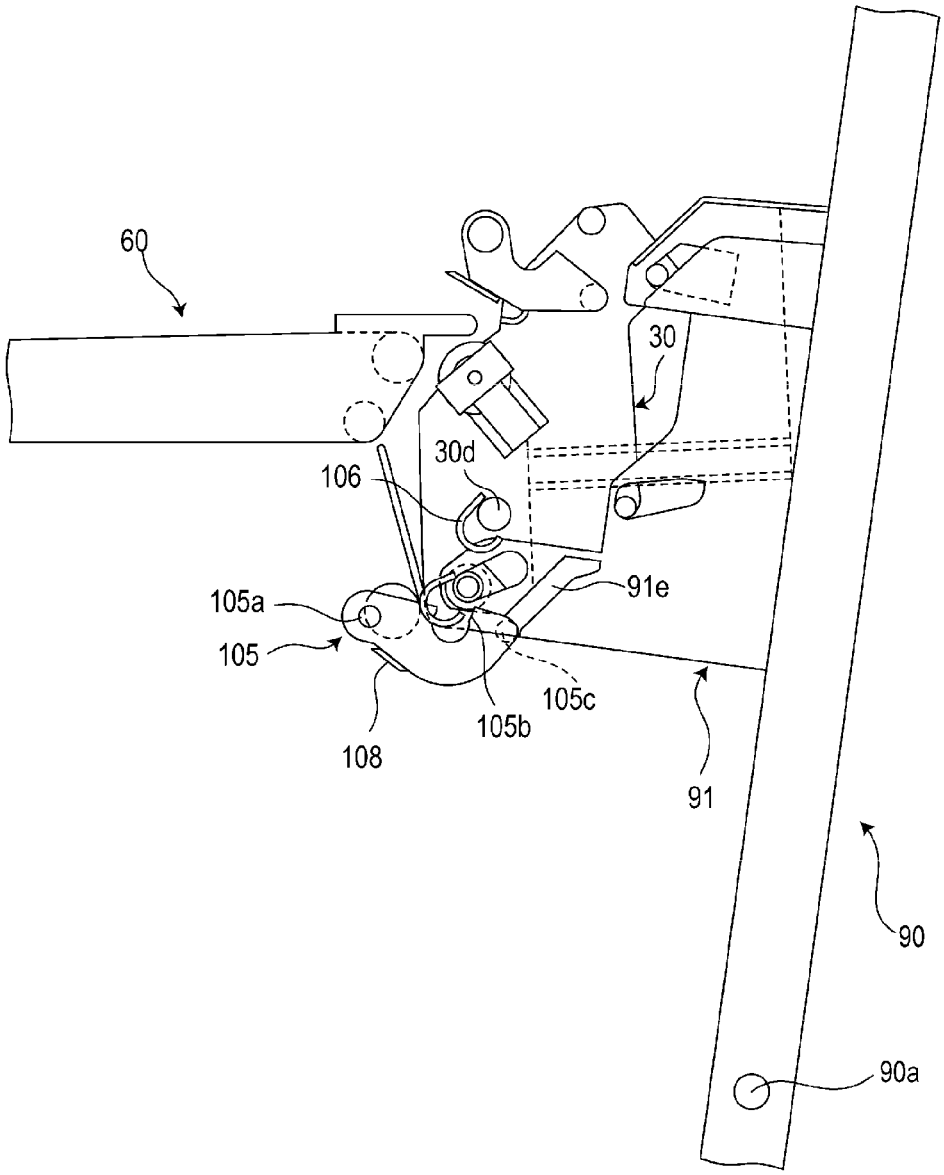
FIG. 6 is a side view illustrating a closing operation of the door of the first embodiment of the present invention.

As shown in FIG. 6, door 90 is closed around the rotational center 90*a*. Then, the fitting projection 30*d* of the secondary transfer unit 30 comes into contact with the entrance of the fitting hole 106 disposed in the image forming apparatus 1.

On the other hand, the lock angle restricting portion 105*c* of the registration lock arm 105 provided in the image forming apparatus 1 is in contact with the entrance of the registration guide 91*e* formed at the lower end of the unit holder 91. In this case, the restricting member 108 formed in the image forming apparatus 1 supports the lower end of the registration lock arm 105. Therefore, the lock angle restricting portion 105*c* is securely guided into the entrance of the registration guide 91*e*.

Figure 7:
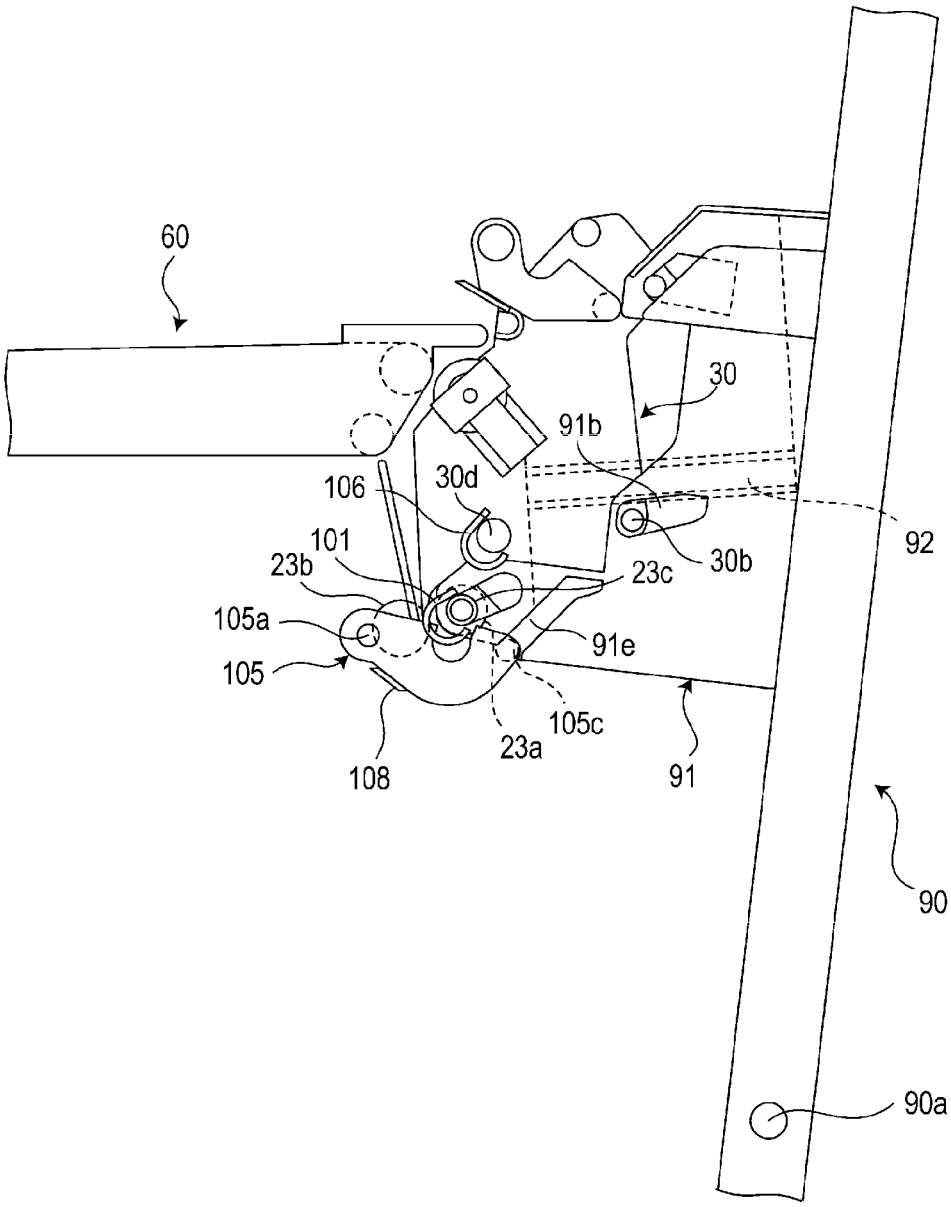
FIG. 7 is a side view illustrating the closing operation of the door of the first embodiment of the present invention.

As shown in FIG. 7, when the door 90 is further closed, the fitting projection 30*d* of the secondary transfer unit 30 enters the fitting hole 106. In this case, since the fitting projection 30*d* receives a drag from the fitting hole 106, the horizontal position of the secondary transfer unit 30 is maintained while the secondary transfer unit 30 is pressed with the biasing force of the floating spring 92. As a result, the lower restricting portion 30*b* of the secondary transfer unit 30 is disengaged from the lower restricting guide hole 91*b* of the unit holder 91.

On the other hand, in accordance with the movement of the lock angle restricting portion 105*c* along the slope of the registration guide 91*e*, the registration lock arm 105 rotates counterclockwise around the rotational center 105*a*. As a result, the registration drive roller bearing 23*c* of the registration drive roller 23*a* is guided into the fitting hole 101 provided in the image forming apparatus 1.

Figure 8:
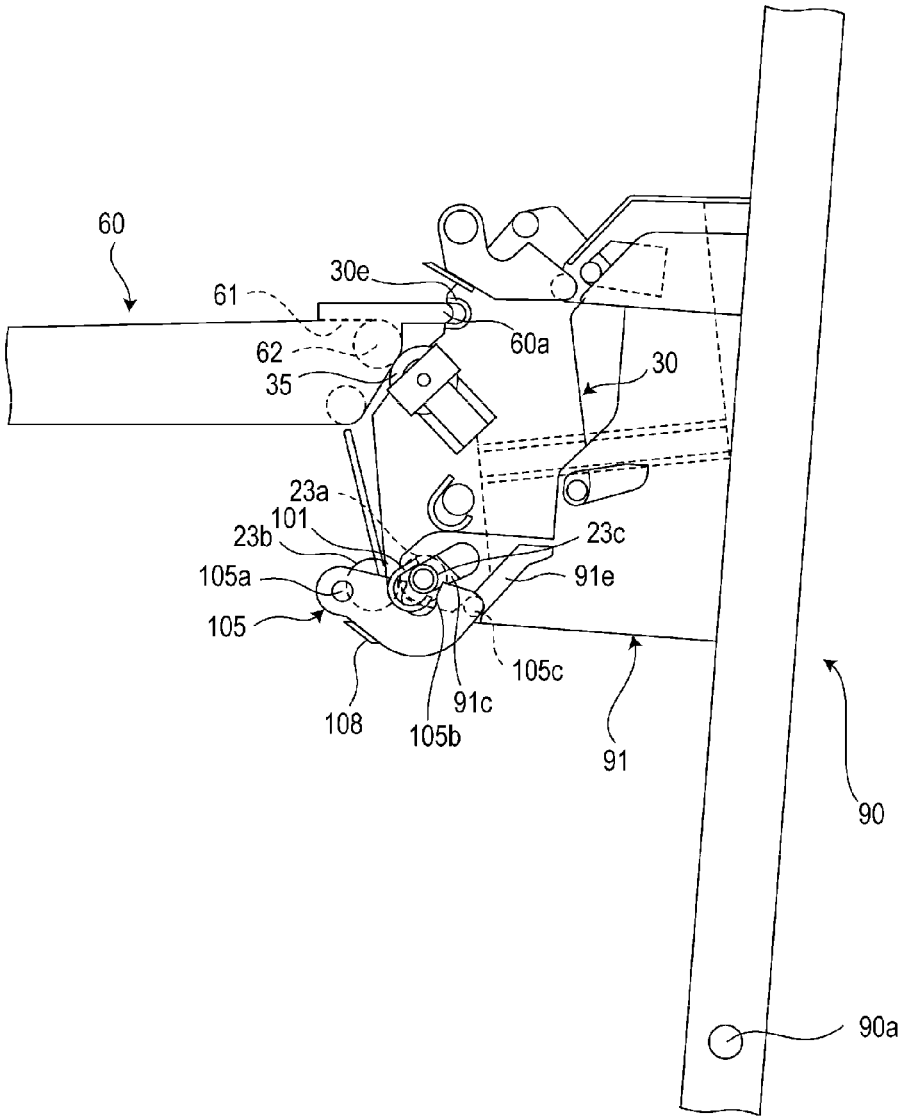
FIG. 8 is a side view illustrating the closing operation of the door of the first embodiment of the present invention.

As shown in FIG. 8, when the door 90 is further closed, the secondary transfer outer roller 35 assembled integrally with the secondary transfer unit 30 is in contact with the intermediate transfer belt 61 of the intermediate transfer unit 60. Also, the positioning projections 60*a* of the intermediate transfer unit 60 enter the fitting groove 30*e* formed on the secondary transfer unit 30.

On the other hand, in accordance with the movement of the lock angle restricting portion 105*c* along the slope of the registration guide 91*e*, the registration lock arm 105 further rotates around the rotational center 105*a*. As a result, since the lock portion 105*b* presses the registration drive roller bearing 23*c*, the registration drive roller bearing 23*c* is gradually guided into the fitting hole 101.

Figure 9:
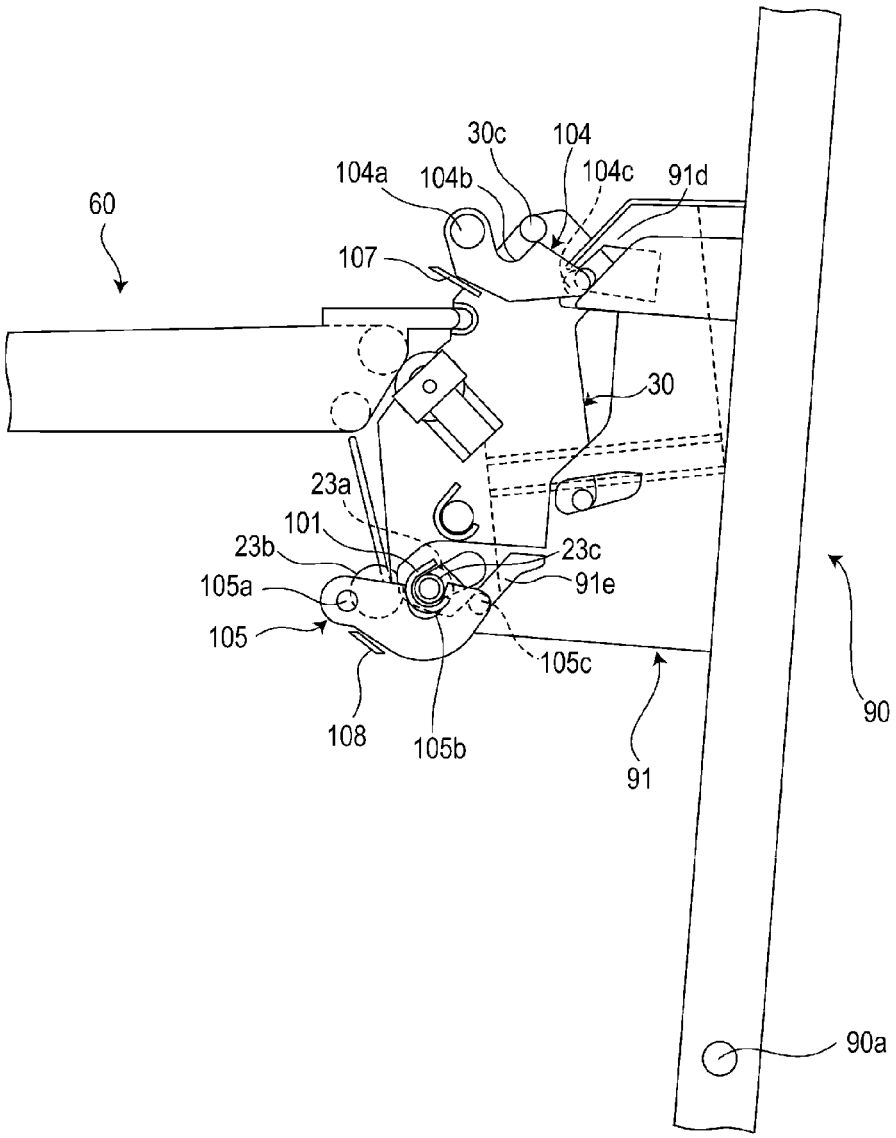
FIG. 9 is a side view illustrating the closing operation of the door of the first embodiment of the present invention.

As shown in FIG. 9, when the door 90 is further closed, the lock angle restricting portion 104*c* of the transfer lock arm 104 disposed at an upper portion of the image forming apparatus 1 enters and becomes in contact with the entrance of lock portion guide 91*d* formed at the upper end of the unit holder 91. Thereafter, the lock portion 104*b* with a wedge shape of the transfer lock arm 104 begins to engage with the positioning portion 30*c* disposed at the upper end of the secondary transfer unit 30. In this case, the force which the door 90 receives from the transfer lock arm 104 becomes a peak and the effect of the transfer lock arm 104 on the operating force of the door 90 is maximized (see P1 in FIG. 11).

On the other hand, in accordance with the movement of the lock angle restricting portion 105*c* along the slope of the registration guide 91*e*, the registration lock arm 105 further rotates around the rotational center 105*a*. Then, by the effect of the lock portion 105*b* on the registration drive roller bearing 23*c*, the registration drive roller bearing 23*c* is disengaged from the roller restricting guide hole 91*c* disposed at the lower end of the unit holder 91. In addition, the registration drive roller bearing 23*c* is fitted to the fitting hole 101. In this case, the registration drive roller 23*a* is in contact with the registration driven roller 23*b* of the main body.

Figure 10:
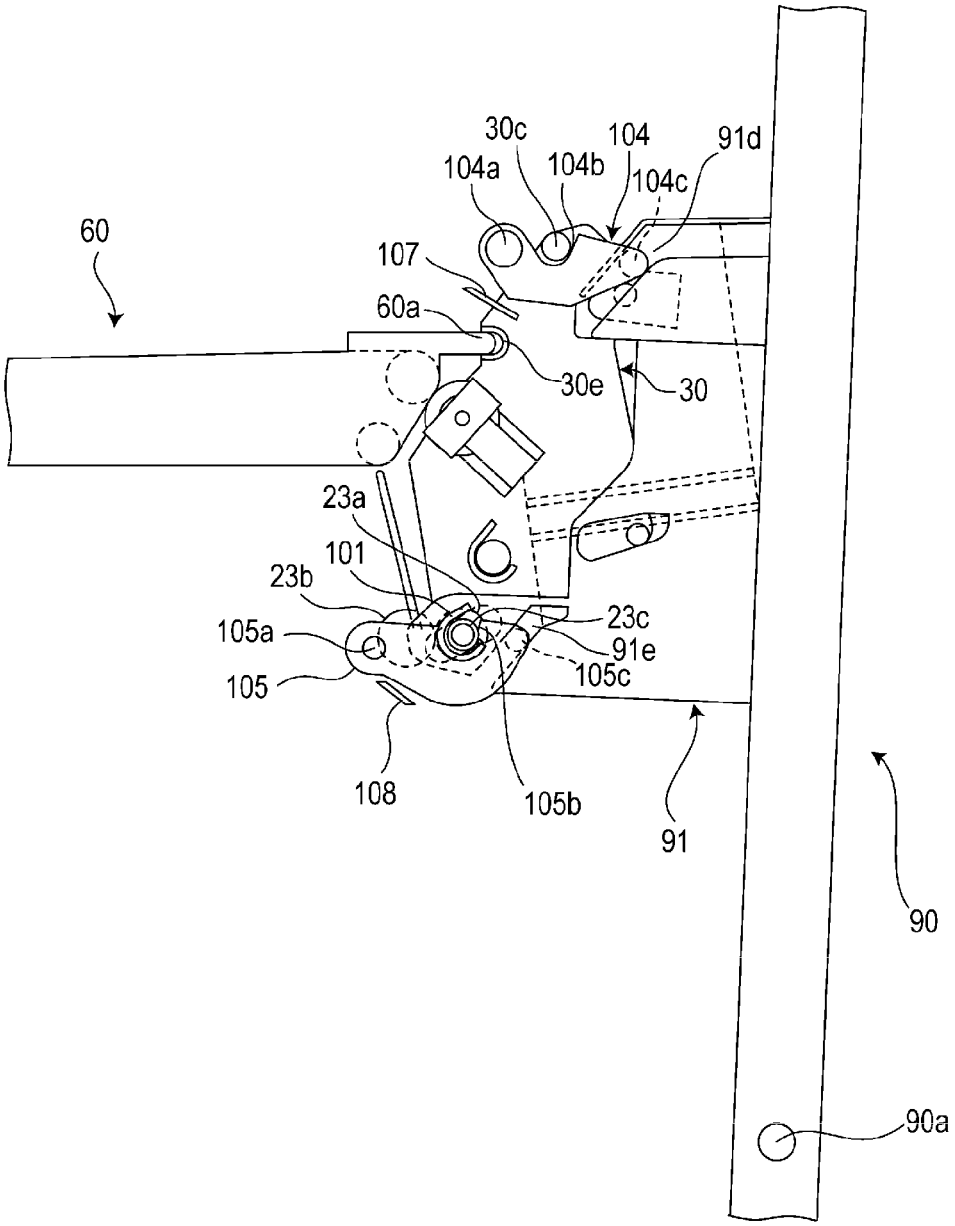
FIG. 10 is a side view illustrating the closing operation of the door of the first embodiment of the present invention.

As shown in FIG. 10, when the door 90 is further closed, the lock angle restricting portion 104*c* moves along the lock portion guide 91*d* as a first guide, thereby the transfer lock arm 104 rotates around the rotational center 104*a*. When the door 90 is moved to the closed position, the positioning portion 30*c* of the secondary transfer unit 30 is completely engaged with the lock portion 104*b* of the transfer lock arm 104. Thus, the upper portion of the secondary transfer unit 30 is locked by the transfer lock arm 104.

At this time, the positioning projections 60*a* of the intermediate transfer unit 60 enter the fitting groove 30*e* of the secondary transfer unit 30 in the horizontal direction and are fitted to the fitting groove 30*e*. Thereby, the vertical movement of the positioning projection 60*a* is restricted and the intermediate transfer unit 60 is positioned to the normal position.

On the other hand, in accordance with the movement of the lock angle restricting portion 105*c* along the slope of the registration guide 91*e*, the registration lock arm 105 further rotates around the rotational center 105*a*. Then, the lock portion 105*b* of a wedge shape is engaged with the registration drive roller bearing 23*c*. In this case, the force required to operate the door 90, which is received from the registration lock arm 105 becomes a peak and the effect of registration lock arm 105 on the operating force of the door 90 becomes maximum (see P2 in FIG. 11).

As shown in FIG. 2, when the door 90 is finally closed, the lock angle restricting portion 104*c* of the transfer lock arm 104 is moved to the restricting position where the inclination of the slope of the lock portion guide 91*d* of the unit holder 91 is changed. Then, the positioning portion 30*c* is locked by the lock portion 104*b*. Thus, the upper portion of the secondary transfer unit 30 is fixed.

On the other hand, the lock angle restricting portion 105*c* of the registration lock arm 105 is moved to the restricting position where the inclination of the slope of the registration guide 91*e* as a second guide is changed. Then, the registration drive roller bearing 23*c* is locked by the lock portion 105*b*. As a result, the position of the registration drive roller 23*a* is determined.

As explained above, the transfer lock arm 104 for fixing the secondary transfer unit 30 and the registration lock arm 105 for fixing the registration drive roller 23*a* are separately provided in this embodiment. Further, the registration lock arm 105 is disposed at an upstream side in the recording material conveying direction with respect to the second transfer portion where the transfer drive roller 62 is in contact with the second transfer outer roller 35. Further, the registration lock arm 104 is disposed at a downstream side in the recording material conveying direction with respect to the second transfer portion. Thus, when the door 90 is opened and the secondary transfer unit 30 is separated, the portion where the registration roller pair 23 exists and the recording material conveying path including the secondary transfer portion are exposed.

Therefore, in opening the door 90 when jam of the recording material has occurred, good visibility of the recording material conveying path can be obtained. Also, since the registration drive roller 23*a* is separated from the registration driven roller 23*b*, when the recording material is retained at the registration roller pair 23, the holding of the recording material is released if the door 90 is opened, thereby good workability can be obtained.

Furthermore, the positioning portion 30*c* of the secondary transfer unit 30 is locked by the transfer lock arm 104 and the registration drive roller bearing 23*c* of the registration drive roller 23*a* is locked by the registration lock arm 105. Thus, the secondary transfer unit 30 is fixed at two positions of an upstream side and a downstream side with respect to the secondary transfer portion, thereby the contact pressure of the secondary transfer portion is dispersed. As a result, the operating force for closing the door can be reduced, which will be explained later in detail.

Figure 11:
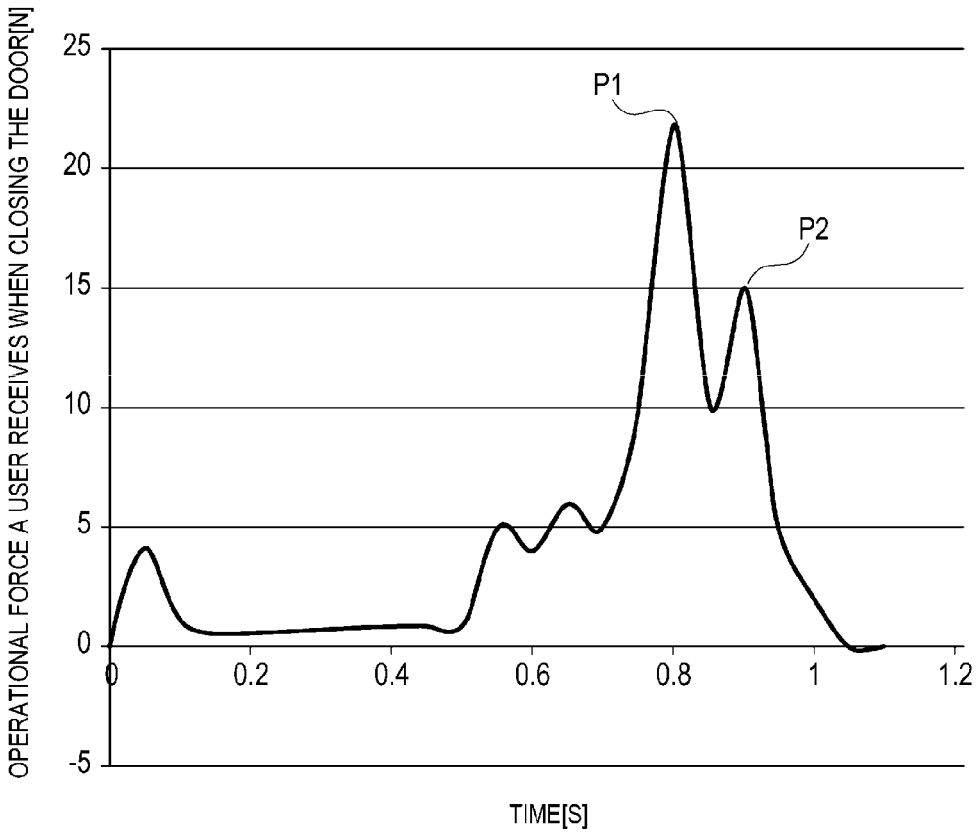
FIG. 11 is a graph showing an operation force received from the door at the time of closing operation of the door of the first embodiment of the present invention.

FIG. 11 is a graph showing the operation force received from the door during the closing operation of the door of the first embodiment. As described above, the present embodiment is configured to stagger the timings of the peak pressures (P1, P2) applied to the transfer lock arm 104 and the registration lock arm 105. Therefore, the operating force of a user can be reduced when closing the door 90.

Next, the case where the door 90 is closed with momentum will be explained. The secondary transfer unit 30 is biased to the direction of the inside of the apparatus by the floating spring 92. Therefore, even if the door 90 is closed with momentum, the door 90 is closed while the upper restricting portion 30*a* and the lower restricting portion 30*b* of the secondary transfer unit 30 are held in the upper restricting guide hole 91*a* and in the lower restricting guide hole 91*b* at positions where the lower restricting portion 30*b* and the upper restricting portion 30*a* are biased respectively.

However, the registration drive roller 23*a* is supported in the direction of gravity by the roller restricting guide hole 91*c* of the unit holder 91 via the registration drive roller bearing 23*c*. Therefore, if an impact is applied when the door 90 is closed with momentum, the registration drive roller 23*a* is bound. Then, the registration lock arm 105 is likely to lock the registration drive roller bearing 23*c* while the registration drive roller bearing 23*c* is not guided to the fitting hole 101. In this case, it may occur that the door 90 is not closed properly.

Therefore, in the present embodiment, a portion of the housing of the secondary transfer unit which is opposed to the registration drive roller 23*a* is located in the vicinity of the registration drive roller 23*a* (see FIG. 5). Since this part is a backup structure in which when the door 90 is closed, the movement amount of the registration drive roller 23*a* which follows the direction of the door 90 is restricted within a certain amount, the part is referred to as the backup unit 30*f*.

With this configuration, even when the registration drive roller 23*a* is bound at the time of closing operation of the door 90, the movement of the registration drive roller 23*a* in the roller restriction guide hole 91*c* is restricted by the backup unit 30*f* of the secondary transfer unit 30 pressed by the floating spring 92. Thus, before the registration drive roller bearing 23*c* begins to be locked by the registration lock arm 105, the registration drive roller 23*c* is guided into the fitting hole 101.

Figure 12:
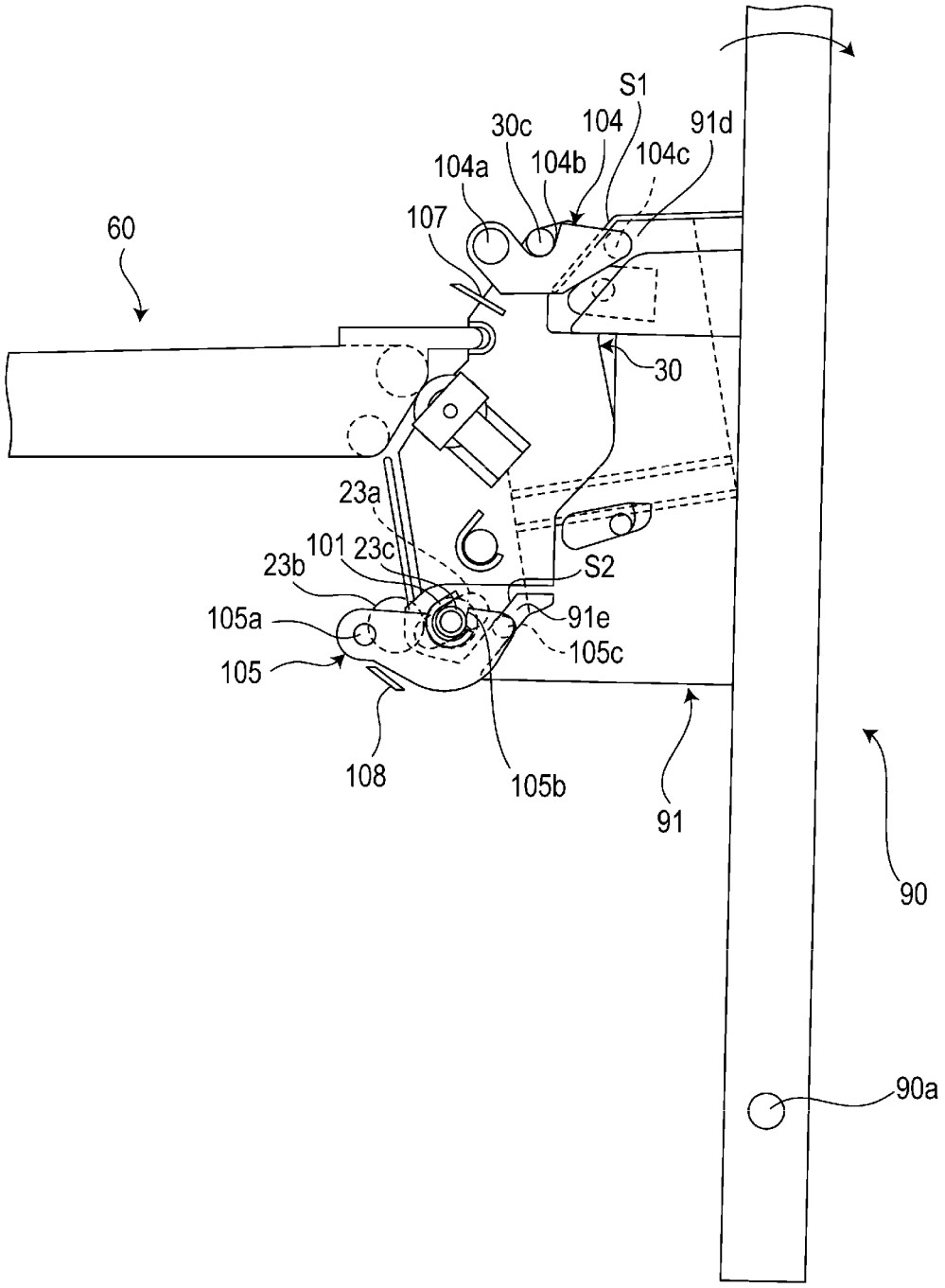
FIG. 12 is a side view illustrating an opening operation of the door of the first embodiment of the present invention.

(Opening operation of the door) Next, the operation of opening the door 90 by a user for the maintenance such as jam recovery will be explained. FIG. 12 is a side view for explaining the opening operation of the door of the first embodiment.

When the door 90 is gradually opened, the slope of the lock portion guide 91*d* (the slope S1 of the inner side of the apparatus) becomes in contact with the lock angle restricting portion 104*c* of the transfer lock arm 104. By the drag from the slope S1, the transfer lock arm 104 is rotated around the rotational center 104*a*. As a result, the lock of the positioning portion 30*c* by the transfer lock arm 104 is released.

On the other hand, the slope of the registration guide 91*e* (the slope S2 of the inner side of the apparatus) is in contact with the lock angle restricting portion 105*c* of the registration lock arm 105. Then, by the drag from the slope S2, the registration lock arm 105 is rotated around the rotational center 105*a*. As a result, the lock of the registration drive roller bearing 23*c* by the registration lock arm 105 is released.

When the door 90 is finally opened, the lower end of the transfer lock arm 104 is in contact with the restricting member 107 as shown in FIG. 5. Also, the lower end of the registration lock arm 105 is in contact with the restricting member 108. As a result, the postures of the transfer lock arm 104 and the registration lock arm 105 are maintained.

In this way, the transfer lock arm 104 and the registration lock arm 105 are provided separately in this embodiment. As a result, the recording material conveying path at registration rollers and the secondary transfer portion is exposed, thereby good visibility can be obtained and it is not necessary to pull out the recording material from the nip of the registration rollers when jam of the recording material occurs.

Second Embodiment

Next, the configuration of the second embodiment of the present invention will be described with reference to the drawings. Then, the opening operation of the door 90 will be explained using side views illustrating the opening operation of the door of the second embodiment of FIGS. 13 to 15. The door 90 is gradually opened in the order from FIG. 13 to FIG. 15. The same configuration as the first embodiment will be denoted by the same reference numerals and the explanation thereof will be omitted. Also, the explanation of the closing operation of the door 90 will be omitted because the closing operation of the door 90 of this embodiment is same as that of the first embodiment.

Figure 13:
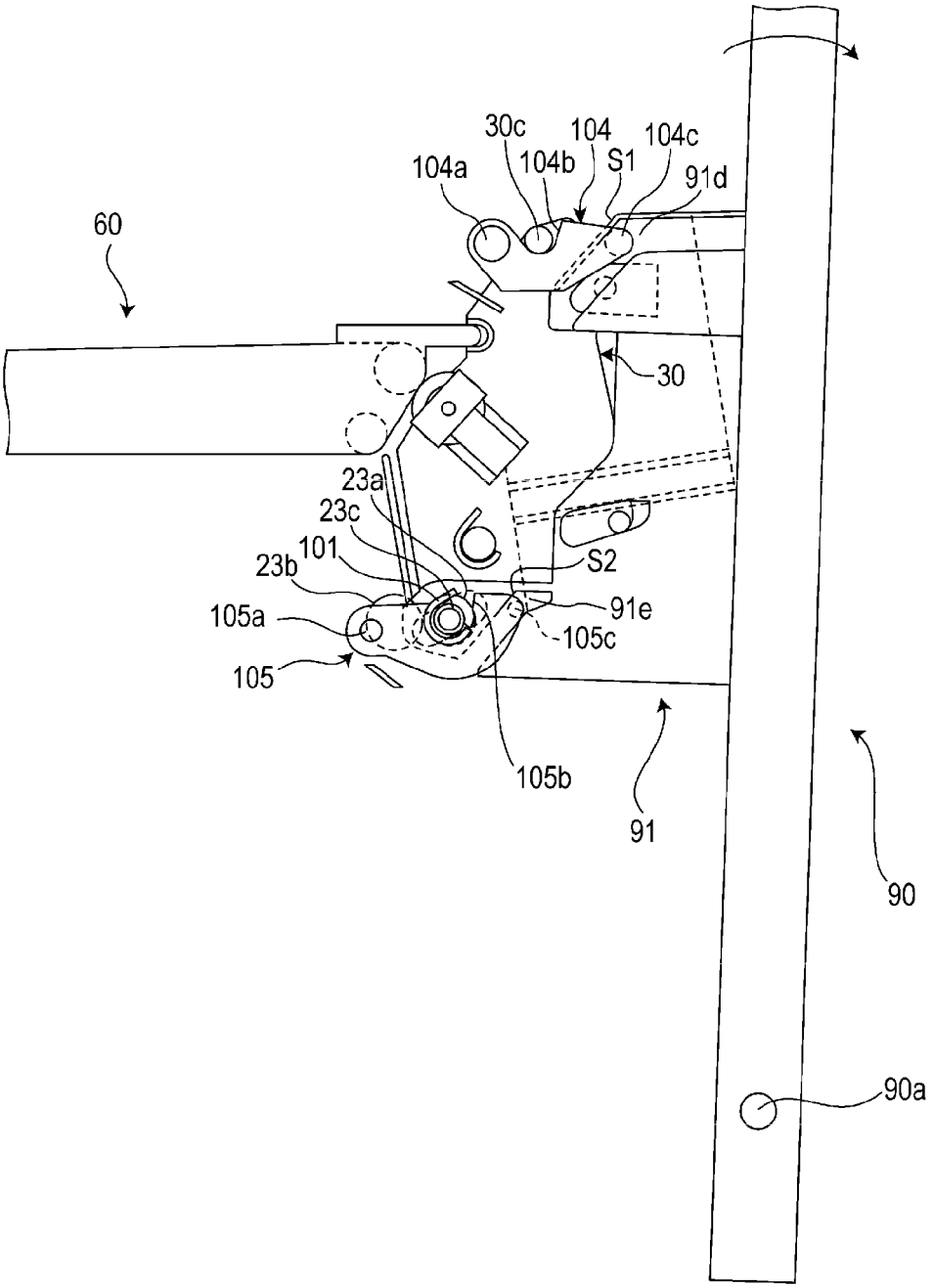
FIG. 13 is a side view illustrating the opening operation of the door of the second embodiment of the present invention.

(Opening operation of the door) Next, the operation of opening the door 90 by a user for the maintenance such as jam recovery will be explained. As illustrated by FIG. 13, when the door 90 is gradually opened, the slope of the lock portion guide 91*d* (the slope S1 of the inner side of the apparatus) becomes in contact with the lock angle restricting portion 104*c* of the transfer lock arm 104. By the drag from the slope S1, the transfer lock arm 104 is rotated around the rotational center 104*a* in the direction of releasing the lock.

On the other hand, at this time, the lock angle restricting portion 105*c* of the registration lock arm 105 is not in contact with the slope of the registration guide 91*e* (the slope S2 of the inner side of the apparatus). For this reason, the operating force from the registration lock arm 105 to the door 90 has not yet been transmitted.

Thereafter, when the positioning portion 30*c* of a cylindrical shape slides in the lock portion guide 91*d*, the engagement of the positioning portion 30*c* of the lock portion 104*b* of the transfer lock arm 104 is released. In this case, the force which the door 90 receives from the transfer lock arm 104 becomes a peak and the effect of transfer locking arm 104 on the operating force of the door 90 is maximized (see P3 in FIG. 16).

Figure 14:
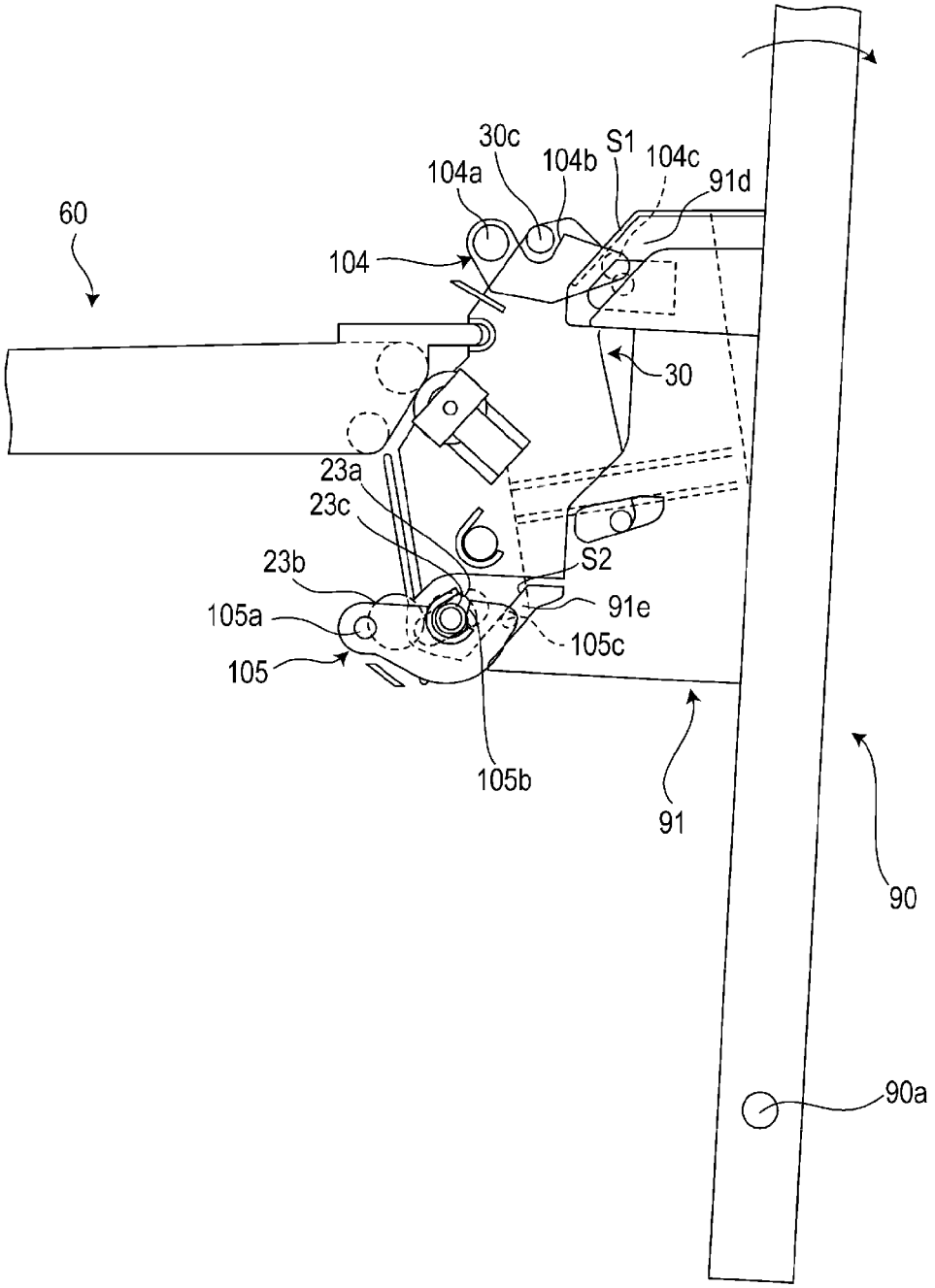
FIG. 14 is a side view illustrating the opening operation of the door of the second embodiment of the present invention.

As shown in FIG. 14, when the door 90 is gradually opened, the slope near the tip of the lock portion 104*b* of the transfer lock arm 104 becomes in contact with the positioning portion 30*c* of a cylindrical shape. Then, by the effect of the nip pressure of the transfer portion, the unlocking is assisted, thereby the force for opening the door 90 is reduced.

On the other hand, the slope of the registration guide 91*e* (the slope S2 of the inner side of the apparatus) is in contact with the lock angle restricting portion 105*c* of the registration lock arm 105. Then, the registration lock arm 105 is rotated around the rotational center 105*a*. As a result, the lock of the registration drive roller bearing 23*c* by the registration lock arm 105 is released.

Also, the slope near the tip of the lock portion 105*b* of the registration lock arm 105 and the registration drive roller bearings 23*c* becomes gradually disengaged while sliding. In this case, the force which the door 90 receives from the registration lock arm 105 becomes a peak and the effect of the registration lock arm 105 on the operating force of the door 90 is maximized (see P4 in FIG. 16).

Figure 15:
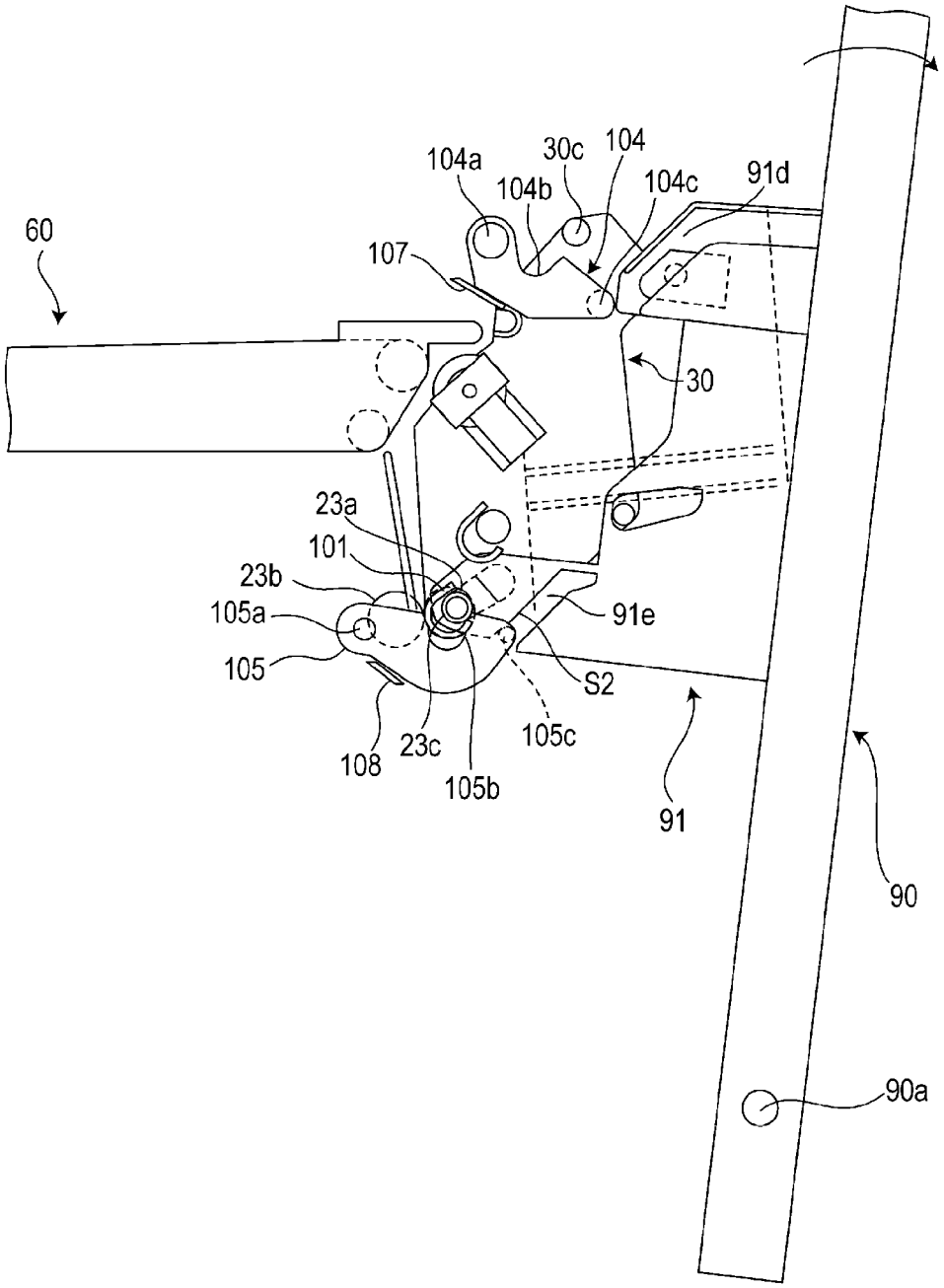
FIG. 15 is a side view illustrating the opening operation of the door of the second embodiment of the present invention.

As shown in FIG. 15, when the door 90 is gradually opened, the lock of the transfer lock arm 104 for the positioning portion 30*c* of the secondary transfer unit 30 of the transfer lock arm 104 is released. Then, the lower end of the transfer lock arm 104 is in contact with the restricting member 107.

On the other hand, when the slope near the tip of the lock portion 105*b* of the registration lock arm 105 is in contact with the registration drive roller bearing 23*c*, the unlocking is assisted by the effect of the nip pressure of registration rollers, thereby the force for opening the door 90 is reduced.

When the door 90 is finally opened, the lower end of the transfer lock arm 104 is in contact with the restricting member 107 as shown in FIG. 15. Also, the lower end of the registration lock arm 105 is in contact with the restricting member 108. As a result, the postures of the transfer lock arm 104 and the registration lock arm 105 are maintained.

In this way, the transfer lock arm 104 and the registration lock arm 105 are provided separately in this embodiment. As a result, the recording material conveying path at the registration rollers and the secondary transfer portion is exposed, thereby good visibility can be obtained and it is not necessary to pull out the recording material from the nip of the registration rollers when jam of the recording material occurs.

Further, in this embodiment, the force received from the nip pressure of the registration rollers and the secondary transfer portion can be used when the door 90 is opened. Therefore, the operational force for opening the door 90 can be reduced.

Figure 16:
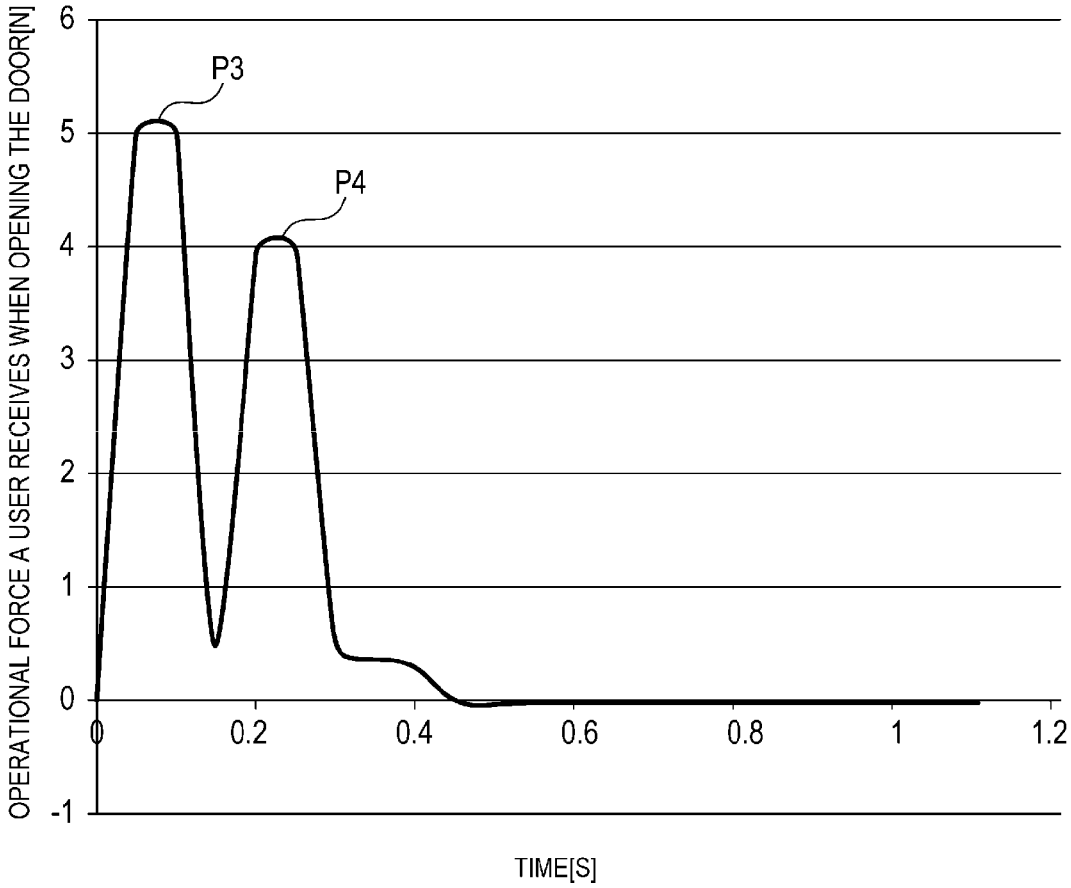
FIG. 16 is a graph showing an operation force received from the door at the time of opening operation of the door of the second embodiment of the present invention.

FIG. 16 is a graph showing the operational force received from the door during the opening operation of the door of the second embodiment. As described above, the present embodiment is configured to stagger the timings of the peak pressures (P3, P4) applied to the transfer lock arm 104 and the registration lock arm 105. Therefore, the operational force of a user can be reduced when opening the door 90.

As described above, the present invention can provide an image forming apparatus in which the operational force for opening and closing the door is reduced and good visibility can be obtained and it is not necessary to pull out the recording material from the nip of the registration rollers when jam of the recording material occurs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112409, filed May 30, 2014 which is hereby incorporated by reference herein in its entirety.

What is claimed is:

1. An image forming apparatus, comprising:

an image bearing member which is provided in the main body of the image forming apparatus, the image bearing member bearing a toner image;

a transfer unit which includes a transfer member for transferring the toner image borne on the image bearing member to a recording material;

a door which is movably provided on the main body, the door movably holding the transfer unit;

a roller pair including a first roller which is movably held by the door and a second roller provided on the main body, the roller pair conveying the recording material to which the toner image borne on the image bearing member is transferred by the transfer member;

a transfer positioning member which is provided on the main body such that the transfer positioning member is interlocked with rotation of the door, the transfer positioning member positioning the transfer unit with the transfer member being in contact with the image bearing member; and a roller positioning member which is provided on the main body such that the roller positioning member is interlocked with rotation of the door, the roller positioning member positioning the first roller with the first roller being in contact with the second roller, wherein when opening the door, the timing of a peak of force for operating the transfer positioning member is different from the timing of a peak of force for operating the roller positioning member.

2. The image forming apparatus according to claim 1, wherein a rotational center portion which is able to be engaged with a groove provided on the main body is provided on the transfer unit, and wherein the transfer unit is rotatable around the rotational center portion by the engagement of the rotational center portion with the groove.

3. The image forming apparatus according to claim 1, wherein when closing the door, the timing of a peak force for operating the transfer positioning member is different from the timing of a peak force for operating the roller positioning member.

4. The image forming apparatus according to claim 1, wherein an elastic member which presses the transfer unit is provided between the transfer unit and the door.

5. The image forming apparatus according to claim 1, wherein the transfer unit includes a backup unit which restricts the amount of movement of the first roller following the direction of the door when closing the door, and wherein when closing the door, the first roller is guided to a fitting hole formed in the main body for positioning the first roller before the first roller is positioned by the roller positioning member.

6. The image forming apparatus according to claim 1, wherein the door includes a guide which guides the transfer positioning member so as to move the transfer positioning member to a position for positioning the transfer unit in accordance with closing operation of the door.

7. The image forming apparatus according to claim 1, wherein the door includes a guide which guides the roller positioning member so as to move the roller positioning member to a position for positioning the first roller in accordance with closing operation of the door.

8. The image forming apparatus according to claim 1, further comprising a transfer spring which is provided in the transfer unit, the transfer spring generating a transfer nip pressure between the transfer member and the image bearing member by biasing the transfer member to the image bearing member, wherein the transfer positioning member receives a force from the transfer spring via the transfer unit when the door is closed.

9. The image forming apparatus according to claim 1, further comprising a roller biasing spring which generates a nip pressure of the roller pair, wherein the roller positioning member receives a force from the roller biasing spring when the door is closed.

10. An image forming apparatus, comprising:

an image bearing member which is provided in the main body of the image forming apparatus, the image bearing member bearing a toner image;

a transfer unit which transfers the toner image borne on the image bearing member to a recording material, a transfer nip being formed where a sheet of the recording material is sandwiched between the image bearing member and the transfer unit;

a door which is movably provided on the main body;

a roller pair including a first roller which is movably held by the door and a second roller provided on the main body, the roller pair conveying to the transfer nip the recording material to which the toner image borne on the image bearing member is transferred by the transfer unit;

a roller positioning member which is movably provided on the main body, the roller positioning member positioning the first roller which is in contact with the second roller in a state where the door is closed; and a moving portion which is provided on the door and which moves the roller positioning member to a position for positioning the first roller in accordance with a closing operation of the door.

11. The image forming apparatus according to claim 10, wherein the moving portion is not in contact with the roller positioning member when the door is opened and the moving portion comes in contact with the roller positioning member in accordance with the closing operation of the door.

12. The image forming apparatus according to claim 10, further comprising a roller biasing spring which generates a nip pressure of the roller pair, wherein the roller positioning member receives a force from the roller biasing spring when the door is closed.

13. An image forming apparatus, comprising:

an image bearing member which is provided in the main body of the image forming apparatus, the image bearing member bearing a toner image;

a transfer unit which includes a transfer member for transferring the toner image borne on the image bearing member to a recording material, a transfer nip being formed where a sheet of the recording material is sandwiched between the image bearing member and the transfer unit;

a door which is movably provided on the main body, the door movably holding the transfer unit;

a roller pair including a first roller which is movably held by the door and a second roller provided on the main body, the roller pair conveying to the transfer nip the recording material to which the toner image borne on the image bearing member is transferred by the transfer member;

a transfer positioning member which is provided on the main body such that the transfer positioning member is interlocked with rotation of the door, the transfer positioning member positioning the transfer unit with the transfer member being in contact with the image bearing member;

a roller positioning member which is movably provided on the main body, the roller positioning member positioning the first roller which is in contact with the second roller in a state where the door is closed; and a moving portion which is provided on the door and which moves the roller positioning member to a position for positioning the first roller in accordance with a closing operation of the door.

14. The image forming apparatus according to claim 13, wherein a rotational center portion which is able to be engaged with a groove provided on the main body is provided on the transfer unit, and wherein the transfer unit is rotatable around the rotational center portion by the engagement of the rotational center portion with the groove.

15. The image forming apparatus according to claim 13, wherein when opening the door, the timing of a peak of force for operating the transfer positioning member is different from the timing of a peak of force for operating the roller positioning member.

16. The image forming apparatus according to claim 13, wherein an elastic member which presses the transfer unit is provided between the transfer unit and the door.

17. The image forming apparatus according to claim 13, wherein the transfer unit includes a backup unit which restricts the amount of movement of the first roller following the direction of the door when closing the door, and wherein when closing the door, the first roller is guided to a fitting hole formed in the main body for positioning the first roller before the first roller is positioned by the roller positioning member.

18. The image forming apparatus according to claim 13, further comprising a second moving portion which is provided on the door, the second moving portion moving the transfer positioning member to a position for positioning the transfer unit in accordance with the closing operation of the door.

19. The image forming apparatus according to claim 13, further comprising a transfer spring which is provided in the transfer unit, the transfer spring generating a transfer nip pressure between the transfer member and the image bearing member by biasing the transfer member to the image bearing member, wherein the transfer positioning member receives a force from the transfer spring via the transfer unit when the door is closed.

20. The image forming apparatus according to claim 13, further comprising a roller biasing spring which generates a nip pressure of the roller pair, wherein the roller positioning member receives a force from the roller biasing spring when the door is closed.

* * * * *